US009872554B2

(12) United States Patent
Galloway et al.

(10) Patent No.: US 9,872,554 B2
(45) Date of Patent: Jan. 23, 2018

(54) WEARABLE ARTICLE

(71) Applicant: MOXIE ENDEAVORS, INC., Pocatello, ID (US)

(72) Inventors: Kelly J. Galloway, Pocatello, ID (US); Susan M. Barna, Idaho Falls, ID (US); Kolay Johnson, Inkom, ID (US)

(73) Assignee: MOXIE ENDEAVORS, INC., Pocatello, ID (US)

( * ) Notice: Subject to any disclaimer, the term of this patent is extended or adjusted under 35 U.S.C. 154(b) by 48 days.

(21) Appl. No.: 14/938,820

(22) Filed: Nov. 11, 2015

(65) Prior Publication Data

US 2016/0135571 A1 May 19, 2016

Related U.S. Application Data

(60) Provisional application No. 62/079,474, filed on Nov. 13, 2014.

(51) Int. Cl.

| | |
|---|---|
| ***A45F 3/02*** | (2006.01) |
| ***A45F 3/14*** | (2006.01) |
| *A45F 3/00* | (2006.01) |

(52) U.S. Cl.

CPC ..... *A45F 3/02* (2013.01); *A45F 3/14* (2013.01); *A45F 2003/003* (2013.01); *A45F 2003/142* (2013.01)

(58) Field of Classification Search

CPC ..... A45F 3/02; A45F 3/14; A45F 2003/003; A45F 2003/142

USPC ..... 224/257

See application file for complete search history.

(56) References Cited

U.S. PATENT DOCUMENTS

| | | | |
|---|---|---|---|
| 1,110,694 | A | 9/1914 | Jennings |
| 1,683,427 | A | 9/1928 | Turner |
| 3,295,178 | A | 1/1967 | Smith |
| 3,499,416 | A | 3/1970 | Thorsheim |
| 3,599,238 | A | 8/1971 | Matthews |
| 3,931,917 | A | 1/1976 | Zellmer |
| 4,634,031 | A | 1/1987 | Frankhouse |
| 4,653,853 | A | 3/1987 | Bedford |
| 4,722,464 | A | 2/1988 | Wright |
| 5,027,477 | A | 7/1991 | Seron |
| 5,263,618 | A | 11/1993 | Talavera |
| 5,575,004 | A | 11/1996 | Eisele et al. |
| 5,575,044 | A | 11/1996 | Zornes |
| D427,380 | S | 6/2000 | Robertson |
| 6,073,317 | A | 6/2000 | Barison |
| 6,443,347 | B1 | 9/2002 | Elizalde et al. |

(Continued)

OTHER PUBLICATIONS

Jog-A-Lite Inc, http://www.amazon.com/Reflective-Sash-Band-Jog-Lite/dp/B000BRGC3G (accessed Feb. 10, 2016), (see Exhibit U for more details).

(Continued)

*Primary Examiner* — Peter Helvey

(74) *Attorney, Agent, or Firm* — Flaig Law Office, PLLC; Jason E. Flaig

(57) ABSTRACT

Wearable articles and methods for configuring wearable articles and using wearable articles are described. A top portion, a front portion, a bottom portion, and a back portion are disclosed. At least one means for releasably configuring aspects of a wearable article is disclosed. At least one means on a wearable article for attaching, carrying and/or displaying items to it is disclosed. At least one means for adjusting the size of the at least one aspect of a wearable article is disclosed.

17 Claims, 7 Drawing Sheets

(56) References Cited

U.S. PATENT DOCUMENTS

| | | | |
|---|---|---|---|
| 6,491,196 | B1 | 12/2002 | Coler |
| 6,644,527 | B1 | 11/2003 | Karenga |
| 6,769,137 | B2 | 8/2004 | D'Annunzio |
| 6,820,280 | B1 | 11/2004 | Atallah et al. |
| D505,787 | S | 6/2005 | Vaughn |
| 7,735,151 | B1 | 6/2010 | Young et al. |
| D661,484 | S | 6/2012 | Hamra |
| 8,191,748 | B2 | 6/2012 | Lessman |
| 8,225,973 | B1 | 7/2012 | Bellinson |
| 8,668,127 | B2 | 3/2014 | Baron |
| 8,752,743 | B2 | 6/2014 | Nazarenko et al. |
| 2004/0094592 | A1 | 5/2004 | Brown |
| 2008/0089056 | A1 | 4/2008 | Grosjean |
| 2008/0203127 | A1 | 8/2008 | Castillo-Garrison |
| 2010/0025447 | A1 | 2/2010 | Smart |
| 2010/0133310 | A1 | 6/2010 | Menzel et al. |
| 2011/0002094 | A1 | 1/2011 | Blouin |
| 2011/0309123 | A1 | 12/2011 | Ashenafi |
| 2012/0080126 | A1 | 4/2012 | Marcin |

OTHER PUBLICATIONS

Steady Eddie, http://www.bigboxbikes.com/viewtopic.php?f=14&t=1693 (referencing www.srm-consult.de/teeth/ref-09.jpg) (accessed Feb. 10, 2016), (see Exhibit V for details).

Sharper Image, http://www.sharperimage.com/si/view/product/Organized-Travelers-Shoulder-Pack/200702?cm_mmc=ymal-__-200702-__-null-__-null#(see Exhibit A for more details).

Julianne, Sewing Bandolier, Sewing Bandolier, http://madebyjulianne.com/sewing-bandolier/ (accessed Feb. 10, 2016), other details unknown or otherwise stated on attachment.

Don, Hip Holster, https://wkdesigner.wordpress.com/2008/08/31/hip-holster/ (accessed Feb. 10, 2016), other details unknown or otherwise stated on attachment.

Iband Sling Hands Free Carry-All, ShowRunnur, http://handsfreecarryall.com/showrunnur-sxsw-fomula1-event-staff/ (accessed Feb. 10, 2016) (see Exhibit D for more details).

Iband Sling Hands Free Carry-All, ShowRunnur, http://handsfreecarryall.com/ (accessed Feb. 10, 2016), other details unknown or otherwise stated on attachment.

Dan+. Runnur, https://web.archive.org/web/20130521006406/http://blog.gifts.com/sneak-peek/guru-approvedrunnur-shoulder-bag (accessed Feb. 10, 2016) (see Exhibit F for details).

James Hannibal, Runnur sling pack, http://www.examiner.com/slideshow/runnur-slingpack#slide=2 (accessed Feb. 10, 2016), other details unknown or otherwise stated on attachment.

Matt, http://www.bikehacks.com/bikehacks/clothing/ (see Exhibit H for more details).

Coolthings, Traveler's Security Bandolier, http://www.coolthings.com/travelers-security-bandolier-wraps-arambo-style-pouch-on-your-body/ (see Exhibit I for more details).

Hammacher Schlemmer, The Traveler's Security Bandolier., Traveler's Security Bandolier, http://www.hammacher.com/product/78157 (accessed Feb. 10, 2016) (see Exhibit J for details).

Setgo, Transport, https://www.setgogear.com/bags/transport (accessed Feb. 10, 2016), other details unknown or otherwise stated on attachment.

Ultimate Parkour Gear, Parkour Backpacks: The Ultimate Guide, http://ultimateparkourgear.com/parkour-backpacks/ (accessed Feb. 10, 2016), (see Exhibit L for more details).

Bandolier, http://www.bandolierstyle.com/shop.html (accessed Feb. 10, 2016), other details unknown or otherwise stated on attachment.

dhgate.com, http://www.dhgate.com/store/product/new-2013-backpack-canvas-bag-sling-waist/160380082.html (see Exhibit N For details).

Quivvers, http://www.quivvers.com/collections/all (accessed Feb. 10, 2016), other details unknown or otherwise stated on attachment.

E-Canvasbags. Shoulder Fanny Pack, Waist Hip Bag. http://www.ecanvasbags.com/shoulder-fanny-pack-waist-hip-bag__1019.html (accessed Feb. 10, 2016), (see Exhibit P for details).

safetyitem.com, 5-pt tear-away Ontario Sash Belt, http://www.safetyitem.com/shop/pc/viewPrd.asp?idproduct=206 (accessed Feb. 10, 2016), (see Exhibit Q for more details).

safetysaves.com, http://www.safetysaves.com/Safety-Shirts-Pants-Vests-Bags-c-142-p-4.html (accessed Feb. 10, 2016), other details unknown or otherwise stated on attachment.

Lw, Lw Yellow Reflective Running Vest belt sash . . . , http://www.amazon.com/o/ASIN/B00E3FD0WS/peteewill-20 (accessed Feb. 10, 2016) (see Exhibit S for more details).

frbiz.com, reflective belts, http://www.frbiz.com/image-reflective-bells (accessed Feb. 10, 2016), other details unknown or otherwise stated on attachment.

WEARABLE ARTICLE

CROSS-REFERENCES TO RELATED APPLICATION

This application claims the benefit of and priority to: Prior U.S. Provisional Application No. 62/079,474, filed on Nov. 13, 2014, which is entitled "WEARABLE ARTICLE".

The entire content of the above document is hereby incorporated herein by reference as part of this application.

BACKGROUND

Technical Field

The disclosure relates at least to the field of wearable articles.

Discussion of Related Field

People desire to attach, carrier and/or display various items on their persons and/or in and/or on their wearable articles. People desire to adjust the size of their wearable articles. Some wearable articles may be worn around a user's neck and, when the weight of the items carried by such wearable articles is increased and/or sustained over a period of time, the user's neck may be strained. Some wearable articles may possess breakaway devices for safety and/or other reasons.

In light of the foregoing discussion, there may be a need for an improved wearable article which may at least allow users to adjust its size, attach, carrier and/or display various items on/to it, and/or provide breakaway capability in one or more embodiments.

SUMMARY

In one aspect, a wearable article may include: a top portion; a front portion; a bottom portion; a back portion; at least one means for releasably configuring at least one portion of the article to at least one portion of the article; at least one means whereon items may be attached and carried; and at least one means for adjusting the size of at least one portion of the article.

Implementations may include one or more of the following features. The at least one means for releasably configuring at least one portion of the article to at least one portion of the article may include at least two breakaway devices. The at least one breakaway device may be configured to the top portion and at least one breakaway device may be configured to the back portion, and the at least two breakaway devices may be releasably configured together. The at least one means for releasably configuring at least one portion of the article to at least one portion of the article may include at least two VELCRO® materials. At least one of the VELCRO® materials may be configured to the back portion and at least one of the VELCRO® materials may be configured to the bottom portion, and the at least two VELCRO® materials may be releasably configured together. The at least one means whereon items may be attached and carried may be configured to at least the front portion. The at least one means whereon items may be attached and carried may be configured to at least the bottom portion. The at least one means for adjusting the size of at least one portion of the article may include at least two VELCRO® materials. At least one of the VELCRO® materials may be configured to the back portion and at least one of the VELCRO® materials may be configured to the bottom portion, and the at least two VELCRO® materials may be configured to be capable of adjusting the size of at least one portion of the article. The article may further include reflective tape located on at least one aspect of front portion. The article may further include a pocket. The top portion, the front portion, the bottom portion and the back portion may include at least one layer of material. The top portion, the front portion, the bottom portion and the back portion may include at least two layers of material. The bottom portion may further include a first bottom portion and a second bottom portion. The first bottom portion and the second bottom portion may be configured together. The first bottom portion and the second bottom portion may be configured together so that at least one portion of the first bottom portion may be positioned superior to and overlaps at least one portion of the second bottom portion. The first bottom portion and the second bottom portion may be configured together so that at least one portion of the second bottom portion may be positioned superior to and overlaps at least one portion of the first bottom portion. The first bottom portion and the second bottom portion may be configured together so at least one aspect of the configuration of the first bottom portion and the second bottom portion to each other may be continuous. The first bottom portion and the second bottom portion may be configured together at a location where a user's anterior section and dorsal section substantially meet. The first bottom portion and the second bottom portion may be configured together and form an angle between about 180 degrees and about 1 degree.

These general and specific aspects may be implemented by using systems, apparatuses, articles, devices, means, methods and structures or any combination thereof.

Certain implementations may provide one or more of the following advantages. Embodiments may not achieve any or all of the listed advantages. Further, this is not an exhaustive list of all possible advantages of the disclosure. One or more embodiment of the disclosure may be configured to be and/or provide users the following.

In one or more embodiments, the disclosure may be configured to combine the functionality of multiple articles and/or products (such as, for example, but not limited to lanyards, safety vests, key chains, cell phone holders, item carriers, displayers and the like and other articles and/or products) into one article. In one or more embodiments, the disclosure may be configured to provide a means for attaching, carrying and/or displaying one or more items, including, for example, but not limited to identifications, work related items, badges, pens, dosimetry, radios, iPods, cell phones, and the like and other items (including, for example, but not limited to those listed herein). In one or more embodiments, the disclosure may be configured to provide a customizable "hip clip" and/or multiple mid-upper body attachment loops/rings. In one or more embodiments, the disclosure may be configured to be a safe option for attaching, carrying and/or displaying multiple items on one article; such may promote proper body placement and ease of access. In one or more embodiments, the disclosure may be configured to allow users to carry and/or display items without the use of their hands. In one or more embodiments, attaching, carrying and/or displaying items on the disclosure instead of the user's clothing may minimize wear and tear on the user's clothing. In one or more embodiments, use of the disclosure may reduce the chance of items being forgotten, lost, dropped and/or misplaced. In one or more embodiments, use of the disclosure may improve workplace efficiency.

In one or more embodiments, the disclosure may be configured to promote the visibility of the user. In one or more embodiments, the disclosure may be configured with various types and colors of fabric or combinations of the same, including, for example, but not limited to orange and/or yellow colors with reflective material for work safety zones or for jogging, walking, or biking; black for professional environments; camouflage for hunting; and the like and other activities. In one or more embodiments, the disclosure may be configured to meet safety standards, rules, regulations, tests and/or requirements, including, for example, but not limited to the American National Standard for High-Visibility Safety Apparel and Headwear (ANSI/ISEA 107-2010) and/or the American National Standard for High-Visibility Public Safety Vests (ANSI/ISEA 207-2011) and as amended. In one or more embodiments, the disclosure may be configured to enhance rather than detract from safety garments.

In one or more embodiments, the disclosure may be configured and/or worn diagonally across the torso and to fit close to the body which may make it safer and less likely to catch on desks, tables, equipment, and/or other things. In one or more embodiments, the disclosure may be configured and/or worn to overlay the user's left shoulder or right shoulder or either shoulder interchangeably. In one or more embodiments, the disclosure may be configured and/or worn to overlay the user's right hip and waist or left hip and waist or either hip and waist interchangeably.

In one or more embodiments, the disclosure may be configured with breakaway safety devices and/or means which may allow the disclosure to be removed from the user's body upon the application of a certain amounts of force; such may eliminate and/or reduce potential strangulation, strain and/or other hazards. In one or more embodiments, the disclosure may be configured so that its use may minimize tension on the user's neck. In one or more embodiments, the disclosure may be configured to be adjustable to accommodate various body sizes. In one or more embodiments, the disclosure may be configured to be adjustable to be worn and fit over indoor clothing or outdoor clothing (such as, for example, but not limited to bulky outerwear during colder weather). In one or more embodiments, the disclosure may be configured to be adjustable by various means. In one or more embodiments, the disclosure may be configured to be lightweight, durable and machine washable.

In one or more embodiments, the disclosure may be configured in such a way so as to make it safe, stylish, comfortable, customizable and/or to accommodate user style preferences. In one or more embodiments, the disclosure may be configured to be usable in various locations and environments, including, for example, but not limited to professional workplace, government facilities, construction zones, hospitals, schools and universities, transportation entities, manufacturing and industrial facilities and the like and other locations and environments.

Other features and advantages may be apparent from the following detailed description, the accompanying drawings, and the claims.

BRIEF DESCRIPTION OF THE DRAWINGS

Various embodiments of the disclosure will now be discussed with reference to the appended drawings. It is appreciated that these drawings depict only typical embodiments of the disclosure and are not to be considered limiting of its scope.

DETAILED DESCRIPTION

The following description illustrates principles of the disclosure which may be applied in various ways to provide different embodiments. There may be many different forms of embodiments of the disclosure, and as such, embodiments should not be limited to those set forth herein and shown in the accompanying drawings. While exemplary embodiments of the disclosure may be shown and described herein, changes and modifications may be made without departing from its scope and concepts. That which is set forth herein and shown in the accompanying drawings is offered to illustrate the principles of the disclosure and one or more embodiments, and not as limitations. Other variations of the disclosure may be included within the principles of the disclosure.

In one or more embodiments, regardless of whether expressly stated herein or illustrated in the accompanying drawings, the disclosure may be configurable, adaptable and customizable to meet the various needs of various users in various circumstances and/or to be compatible and/or used in conjunction with various systems, apparatuses, articles, devices, means, methods and structures.

In one or more embodiments, the disclosure may be configured in various ways, by various means and/or methods, with various components and/or parts, to various dimensions, shapes, and/or sizes and/or with various materials. For example, in one or more embodiments, the specific parts, materials, members, devices, systems and/or components of the disclosure may be configured together, separate and/or with other parts, materials, members, devices, systems and/or components and/or combinations thereof.

In one or more embodiments, the disclosure may be used for various uses and/or various purposes. In one or more embodiments, the drawings herein may but do not necessarily illustrate the disclosure to scale. In one or more embodiments, the drawings herein may but do not necessarily depict the exact positions, sizes, shapes, dimensions, shapes, sizes, layouts, designs, angles and/or other configurations in which the disclosure may be implemented.

In one or more embodiments, each description of the disclosure expressly and inherently described and illustrated herein, may be implemented in no, one or more than one embodiment.

Figure 1:
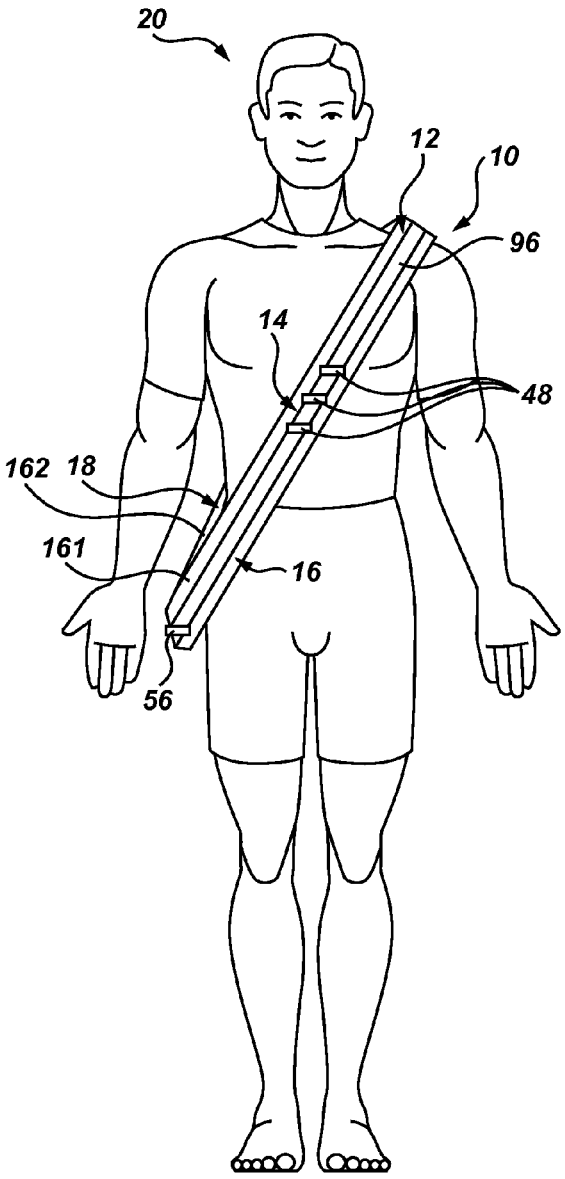
FIG. 1 shows a view of one embodiment of an anterior side of a user wearing one embodiment of the disclosure.
Figure 2:
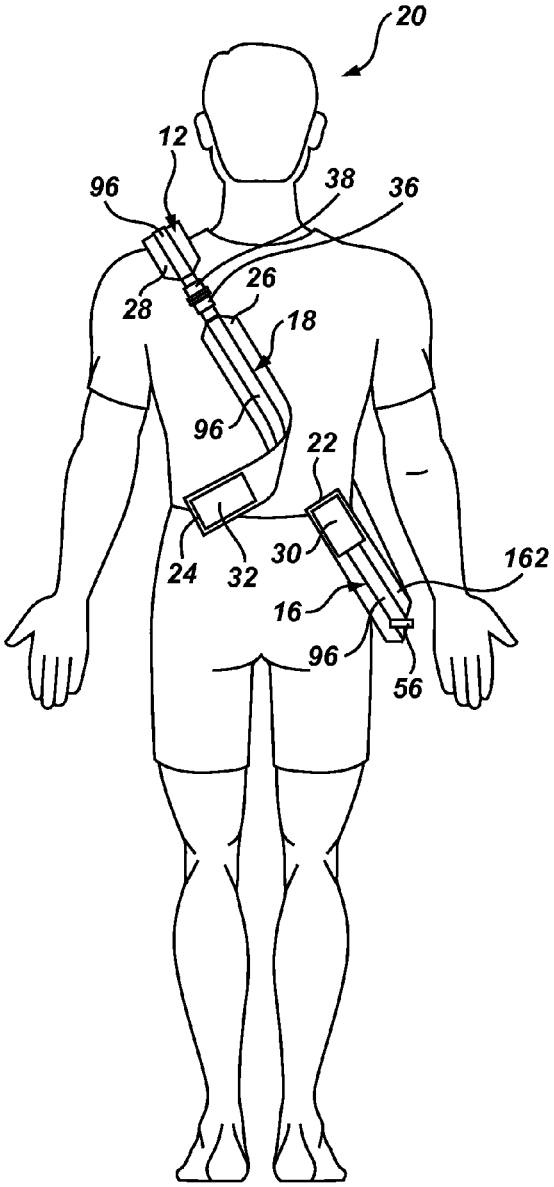
FIG. 2 shows a view of one embodiment of a posterior side of the user wearing one embodiment of the disclosure.

FIGS. 1 and 2 show one embodiment of aspects of an article 10 which may be worn by a user 20. In one or more embodiments, article 10 may be configured to include a top portion 12, a front portion 14, a bottom portion 16, and a back portion 18.

In one or more embodiments, aspects of article 10 (including, for example, but not limited to top portion 12, front portion 14, bottom portion 16, and/or back portion 18) may be configured in various ways, with various materials, to various dimensions (including, for example, but not limited to lengths, widths, heights, distances apart, layers, etc.) and/or for various reasons (including, for example, but not limited to the advantages listed in the Summary section of this application, such as, for example, in order to provide a more comfortable fit, to substantially fit article 10 to the size of the user 20, for personal or professional use, and/or to meet safety standards, rules, regulations, tests and/or requirements).

In one or more embodiments, aspects of article 10 (including, for example, but not limited to top portion 12, front portion 14, bottom portion 16, and/or back portion 18) may be configured using one or more materials or a combination thereof, such as, for example, but not limited to cotton, flax, wool, ramie, silk, yarn, denim, corduroy, leather, suede, down, fur, nylon, polyester, polymer, copolymer, modacrylic, acrylic, Spandex, acetate, cupro, flannel, lyocell, PVC-polyvinyl chloride, reflective PVC high gloss trim tape, rayon, recycled or recovered cotton, recycled PET, recycled paper, Tyvek, bamboo, jute, rubber, plastic, metal, alloy, duct tape, wood, VELCRO®, webbing and the like and other types of material. In one or more embodiments, the material(s) may be composed of natural fabrics and/or synthetic fibers. In one or more embodiments, the material(s) may possess various strengths, elasticities, weights, thicknesses, lengths, widths, angles, heights, colors, shapes, sizes, textures, layers, surfaces, finishes, threads, patterns, embellishments, stitches, blends, directions, overlays, and the like and other characteristics or combinations thereof. For example, in one or more embodiments, aspects of article 10 (including, for example, but not limited to top portion 12, front portion 14, bottom portion 16, and/or back portion 18) may be configured with one or more layers of material. In one or more embodiments, the material(s) may be flame resistant, water resistant, absorbent, tear resistant, reflective, highly-visible, luminescent, transparent, flexible, rigid, biodegradable, antistatic, breathable, abrasion resistant, and the like and other characteristics or combinations thereof. For example, in one or more embodiments, none and/or at least some aspect of article 10 (such as, for example, but not limited to top portion 12, front portion 14, bottom portion 16, and back portion 18) may be configured with a reflective PVC high gloss white trim tape 96 (hereafter, reflective tape 96). In one or more embodiments, reflective tape 96 may be configured onto to none and/or at least some aspect of article 10 so that it may be visible to others when user 20 is wearing article 10. In one or more embodiments, the dimensions of reflective tape 96 may vary. For example, in one or more embodiments, the width of reflective tape 96 may be about 1/32 of an inch to about 12 inches in width (such as, for example, but not limited to about 1 inch in width) and its length may vary depending on the length of the different aspects of article 10 it may be configured to and/or other factors. In one or more embodiments, the outer edges of reflective tape 96 may be configured to run substantially parallel with the outer edges of at least some aspect of article 10. For example, as shown in the embodiments illustrated in FIGS. 1 and 2, reflective tape 96 may be sewn onto about the middle of aspects of top portion 12, front portion 14, bottom portion 16, and back portion 18 and run substantially parallel with the outer edges of each aspect of article 10. Although FIGS. 1 and 2 show an embodiment of article 10 including reflective tape 96, in one or more embodiments, none or at least some aspects of article 10 may be configured with reflective tape 96 or other safety materials.

In one or more embodiments, aspects of article 10 (including, for example, but not limited to top portion 12, front portion 14, bottom portion 16, and/or back portion 18) may be configured in various way (including, for example, but not limited to being configured together and/or apart), including, for example, but not limited to the following: sewing, knitting, weaving, crocheting, melting, burning, gluing, cementing, pressing, cutting, lasering, buttoning, buckling, zipping, snapping, knotting, strapping, fastening, roping, threading, stringing, tying, stitching, clamping, clipping, pining, holing, hooking, pocketing, and using breakaway device(s), VELCRO®, and any other materials, adhesives, devices, systems, means, and methods, and/or combinations thereof.

In one or more embodiments, none or at least some aspect of article 10 (including, for example, but not limited to top portion 12, front portion 14, bottom portion 16, and/or back portion 18) may be configured with at least one means for adjusting it in various ways, with various materials, to various dimensions, and/or for various reasons (such as, for example, but not limited to for purposes of adjusting its fit). In one or more embodiments, such mean(s) may be accomplished by but not limited to such means as VELCRO®, button(s), buckle(s), zipper(s), snap(s), knot(s), strap(s), fastener(s), rope(s), thread(s), string(s), tie(s), stitch(s), clamp(s), clip(s), pin(s), hole(s), hook(s), pocket(s), breakaway device(s), materials, and any other materials, adhesives, devices, systems, means, and methods, and/or combinations thereof. In one or more embodiment, such means may be configured to be releasable or not releasable. In one or more embodiment, such means may be located at any one or more than one locations on article 10. In one or more embodiment, such means may be configured in a variety of ways, with a variety of materials, to a variety of dimensions, and/or for a variety of reasons. In one or more embodiments, the materials and/or means used (such as, for example, but not limited to VELCRO®) to configure aspects of article 10 may allow a user 20 to repeatedly adjust the fit of article 10 in various ways, to various dimensions, and/or for various reasons.

In one or more embodiments, none or at least some aspect of article 10 (including, for example, but not limited to top portion 12, front portion 14, bottom portion 16, and/or back portion 18) may be configured with at least one means for being releasably and/or non-releasably configured to other aspects of article 10. In one or more embodiments, such mean(s) may be accomplished by but not limited to such means as VELCRO®, button(s), buckle(s), zipper(s), snap(s), knot(s), strap(s), fastener(s), rope(s), thread(s), string(s), tie(s), stitch(s), clamp(s), clip(s), pin(s), hole(s), hook(s), pocket(s), breakaway device(s), materials, and any other materials, adhesives, devices, systems, means, and methods, and/or combinations thereof. In one or more embodiment, such means may be configured to be releasable or not releasable. In one or more embodiment, such means may be located at any one or more than one locations on article 10. In one or more embodiment, such means may be configured in a variety of ways, with a variety of materials, to a variety of dimensions, and/or for a variety of reasons.

In one or more embodiments, none or at least some aspect of article 10 (including, for example, but not limited to top portion 12, front portion 14, bottom portion 16, and/or back portion 18) may be configured with at least one means for attaching, carrying and/or displaying items. In one or more embodiments, such mean(s) may be accomplished by but not limited to such means as VELCRO®, button(s), buckle(s), zipper(s), snap(s), knot(s), strap(s), fastener(s), rope(s), thread(s), string(s), tie(s), stitch(s), clamp(s), clip(s), pin(s), hole(s), hook(s), pocket(s), breakaway device(s), materials, and any other materials, adhesives, devices, systems, means, and methods, and/or combinations thereof. In one or more embodiment, such means may be configured to be releasable or not releasable. In one or more embodiment, such means may be located at any one or more than one locations on article 10. In one or more embodiment, such means may be configured in a variety of ways, with a variety of materials, to a variety of dimensions, and/or for a variety of reasons. In one or more embodiment, the items which may be attached, carried and/or displayed on article 10 may possess a variety of dimensions (including, for example, but not limited to a variety of weights, sizes, shapes, and configurations) and/or be done for a variety of reasons. For example, in one or more embodiments, such items may include but not be limited to identifications, badges, badge holders, badge reels, ropes, strings, cards, name tags, writing utensils, dosimetry devices, MP3 players, radios, iPods, cell phones, cell phone holders/holsters/cases, glasses, cases for holding glasses, note pads, devices, tools, things, wallets, wallet holders, money clips, coins, cash, check books, planners, calendars, notes, erasers, jewelry, broaches, belt clip items, clips, pins, clamps, hooks, holders, holsters, cases, awards, medals, magnets, jump drives, keys, key chains, carabiners, personal items, memorabilia, chatskis, lanyards, water bottles, bottles, microphones, markets, etc. and/or any other attachable, carryable and/or displayable items.

In one or more embodiments, the material(s) used to configure and the manner in which none or at least some aspect of article 10 (including, for example, but not limited to top portion 12, front portion 14, bottom portion 16, and/or back portion 18) may be configured to meet applicable American National Standard Institute (ANSI), Safety Equipment Association (ISEA), American Society for Testing and Materials (ASTM) standards and/or other safety standards, rules, regulations, tests and/or requirements (such as, for example, but not limited to the American National Standard for High-Visibility Safety Apparel and Headwear (ANSI/ISEA 107-2010) and/or the American National Standard for High-Visibility Public Safety Vests (ANSI/ISEA 207-2011)). For example, in one or more embodiments, none or at least some aspect of article 10 (including, for example, but not limited to top portion 12, front portion 14, bottom portion 16, and/or back portion 18) may be configured with reflective, highly-visible, and/or luminescent tape (such as, for example, but not limited to reflective tape 96) and/or none or at least some aspect of article 10 (including, for example, but not limited to top portion 12, front portion 14, bottom portion 16, and/or back portion 18) may be configured with polyester neon orange colored material.

In one or more embodiments, none or at least some aspect of article 10 (including, for example, but not limited to top portion 12, front portion 14, bottom portion 16, and/or back portion 18) may be configured with breakaway devices. Although various drawings herein may illustrates a particular type(s) of breakaway device(s), in one or more embodiments various breakaway devices with various dimensions (such as, for example, but not limited to various sizes, shapes, weights), of various types, materials and/or colors, and/or with various aspects, capacities, features and functionalities may be utilized by the disclosure. For example, in one or more embodiments, breakaway devices may be about 1/32 of an inch to about 6 inches in width (such as, for example, but not limited to about 1 and 1/4 inches in width, about 5/8 of an inch in width, about 1/2 of an inch in width, or about 3/8 of an inch in width), about 1/32 of an inch to about 2 inches in height (such as, for example, but not limited to about 1/4 of an inch in height), and about 1/32 of an inch to about 6 inches in length (such as, for example, but not limited to about 5/8 of an inch in length). In one or more embodiments, breakaway devices may be configured to be about 3/4 of an inch in width, plastic in material, curved in shape and feature a center type of release. In one or more embodiments, breakaway devices may be capable of various weight bearing capacities, such as, for example, but not limited to weight bearing capacities associated with conventional lanyards or more or less weight bearing capacities. In one or more embodiments, breakaway devices may be capable of various weight bearing capacities, such as, for example, but not limited to between about ¼ of an ounce to about 30 lbs. In one or more embodiments, breakaway devices may include buckles, barrels, snaps, clips, holders, hooks, sockets, clasps, clip, clams, buttons, rings, loops, toggles, fasteners, holes and other features and functionalities (including, for example, but not limited to those elsewhere set forth herein) and/or combinations thereof. In one or more embodiments, breakaway devices may be configured to be releasable or non-releasable. In one or more embodiments, breakaway devices may be able to swing, articulate, swivel, bend, curve or possess other features and functionalities and/or combinations thereof. In one or more embodiments, breakaway devices may be curved, flat, rounded or provide other shapes and/or combinations thereof. In one or more embodiments, breakaway devices may provide safety features. In one or more embodiments, breakaway devices may be configured as center release types, side release types or other release types. In one or more embodiments, breakaway devices may be configured from plastic, wood, metal or other materials (including, for example, but not limited to those elsewhere set forth herein) and/or combinations thereof. In one or more embodiments, breakaway devices may be configured to aspects of article 10 by various means, such as, for example, but not limited to via strings, tape, trim, straps, webbing, buckles, stitching, sewing or other materials and/or combinations of means. In one or more embodiments, breakaway devices may be custom made and/or obtained commercially from persons and/or entities such as, for example, but not limited to SnugzUSA, Universal Mercantile Exchange, Inc., Best Buy Button & Buckle, and other retailers and manufactures.

FIGS. 1 and 2 show one embodiment of article 10 which may be configured so that top portion 12 overlays the user's 20 shoulder and bottom portion 16 overlays the user's 20 hip and/or waist situated opposite the shoulder where top portion 12 originates. In one or more embodiments, top potion 12 may be configured to overlay the user's 20 left shoulder (see FIGS. 1 and 2) or right shoulder interchangeably. In one or more embodiments, bottom potion 16 may be configured to overlay the user's 20 right hip and/or waist (see FIGS. 1 and 2) or left hip and/or waist interchangeably. In one or more embodiment, at least one end of top portion 12 may be releasably or non-releasably (see FIG. 1) configured to front portion 14 and the other end of top portion 12 may be releasably (see FIG. 2) or non-releasably configured to back portion 18. In one or more embodiment, at least one end of bottom portion 16 may be releasably or non-releasably (see FIG. 1) configured to front portion 14 and the other end of bottom portion 16 may be releasably (see FIG. 2) or non-releasably configured to back portion 18. In one or more embodiment, top portion 12 may be configured to be continuous with front portion 14 (see FIG. 1). In one or more embodiment, front portion 14 may be configured to be continuous with bottom portion 16 (see FIG. 1).

In one or more embodiments, top portion 12, front portion 14, bottom portion 16, and back portion 18 may each include two layers of material (such as, for example, but not limited to two layers of polyester neon orange material for an industrial safety look and functionality) folded and/or sewn together wherein each layer may be configured to substantially overlap each other. In one or more embodiments, top portion 12, front portion 14, bottom portion 16, and back portion 18 may each include at least one layer of material (such as, for example, but not limited to jean material for a casual look and/or black polyester for a professional look) wherein each layer, if there is more than one layer of material, may be configured to substantially overlap each other.

In one or more embodiments, the width of each layer of each top portion 12, front portion 14, bottom portion 16, and back portion 18 may be of various dimensions. For example, in one or more embodiments, the width may be between about 1/32 of an inch to about 12 inches (such as, for example, but not limited to about 2 and ⅝ inches wide or about 2 and ½ inches wide). In one or more embodiments, in the instance when a single piece of material is folded to create multiple layers, the initial width of the piece of material may vary depending on the number of layers desired, the type of material and/or other factors. For example, in the instance when a single piece of material is used and folded to create two layers, in one or more embodiments, the width of the material may initially be about 6 inches if the final width is desired to between about 2 and ½ inches to about 3 inches wide after folding and/or sewing the material onto itself and/or providing for reinforcement, additional materials and/or other stitching practices.

FIG. 1 shows a view of one embodiment of the anterior side of user's 20 body wherein one or more embodiments of article 10 may be configured so that top potion 12 may overlay the user's 20 left shoulder and continue downward from top portion 12 in a diagonal direction to front portion 14 which may be situated across a user's 20 chest to bottom portion 16 which may overlay the user's 20 right hip and/or waist.

FIG. 2 shows a view of one embodiment of the posterior side of user's 20 body wherein one or more embodiments of article 10 may be configured so that top potion 12 may overlay the user's 20 left shoulder and continue downward from top portion 12 in a diagonal direction and ultimately across a user's 20 back and towards back portion 18 and towards bottom portion 16 which may overlay the user's 20 right hip and/or waist.

Figure 3:
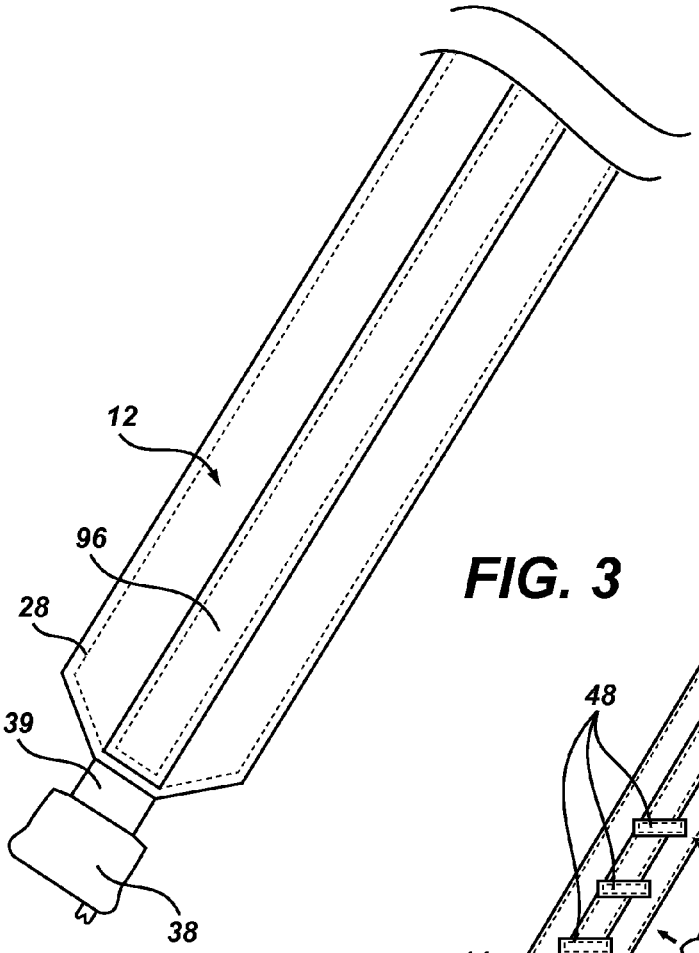
FIG. 3 shows one embodiment of aspects of a top portion of the disclosure.

FIG. 3 shows one embodiment of top portion 12. In one or more embodiments, top portion 12 may be configured to overlay portions of user's 20 left or right shoulders. In one or more embodiments, top portion 12 may include an end 28. In one or more embodiments, end 28 may be situated on the back portion of user's 20 right or left (see FIG. 2) shoulder. Although FIG. 3 (and elsewhere) shows the edges of end 28 as being angled, in one or more embodiments, the shape, size, texture, color and other dimensions, characteristics and functionalities may be modified as needed and/or desired. In one or more embodiments, end 28 may be configured to material 39 by various means (such as, for example, but not limited to sewing). In one or more embodiments, material 39 may be configured from various materials of various dimensions. For example, in one or more embodiments, material 39 may be configured from heavy duty webbing and/or strap material which may be configured to be between about 1/32 of an inch to about 12 inches in width (such as, for example, but not limited to about ¾ of an inch wide) and between about 1/32 of an inch to about 12 inches in length (such as, for example, but not limited to about 1 and ½ inches in length). In one or more embodiments, none or at least some of material's 39 length (such as, for example, but not limited to between about ½ an inch) may be sewn onto, covered and/or in between layers (in the instance of multiple layers) by end 28. In one or more embodiments, material 39 may be configured to breakaway device 38 by various means (such as, for example, but not limited to a buckle or sewing). In one or more embodiments, breakaway device 38 may provide top portion 12 with the ability to be configured to other aspects of article 10 (such as, for example, but not limited to, a complementary breakaway device like breakaway device 36 which may be configured to back portion 18 as described below) and/or other items. In one or more embodiments, breakaway device 38 may be of various dimensions. For example, in one or more embodiments, the width of breakaway device may be between about ¼ of an inch in height, about 1 and ¼ inches in width, and about ⅝ of an inch in length. In one or more embodiments, breakaway device 38 may have a weight bearing capacity similar to or more than what may be conventionally found in a lanyard possessing breakaway capabilities.

Figure 4:
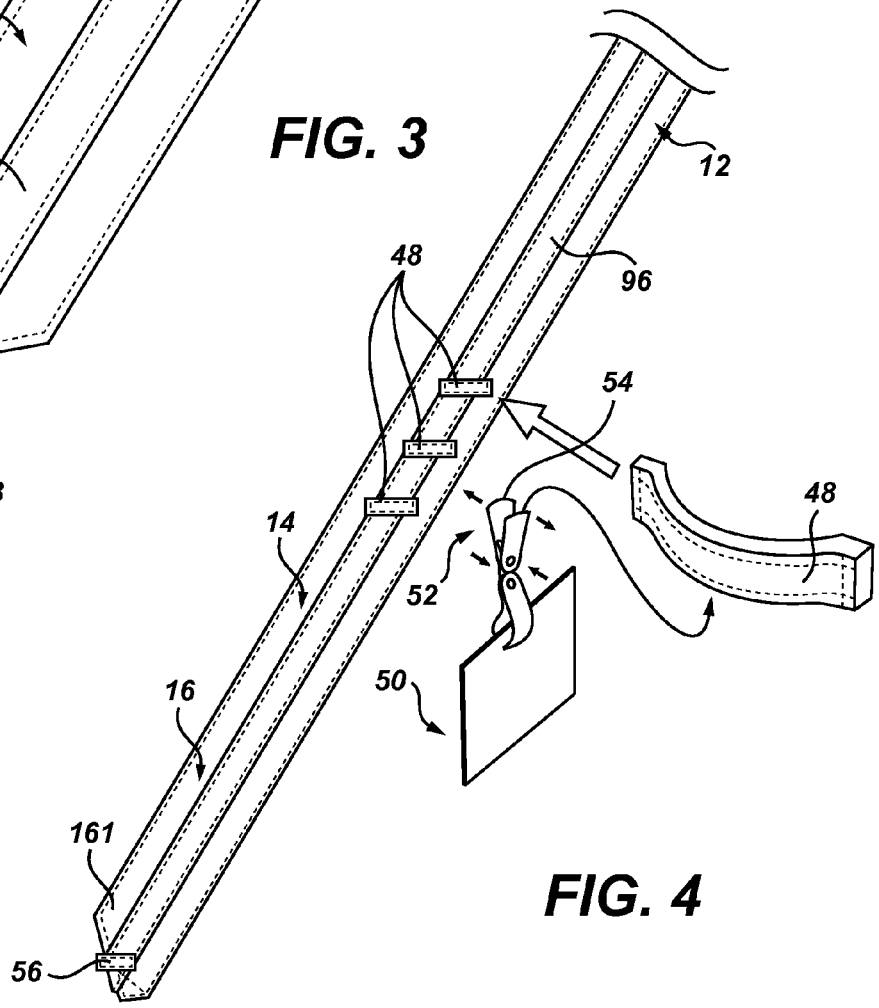
FIG. 4 shows one embodiment of a front portion of the disclosure.

FIG. 4 shows one embodiment of front portion 14. In one or more embodiments, front portion 14 may be configured to overlay parts of user's 20 chest and abdomen. In one or more embodiments, front portion 14 may be configured with at least one means for attaching, carrying and/or displaying items. For example, in one or more embodiments, as shown in FIGS. 1 and 4, front portion 14 may be configured with at least one piece of material 48 (such as, for example, but not limited to three pieces of material 48 as illustrated in FIGS. 1 and 4) upon which various items may be releasably and/or non-releasably attached, carried and/or displayed. In one or more embodiments, the at least one piece of material 48 may be configured to front portion 14 in a fashion similar to how belt loops may be sewn to pants. In one or more embodiments, the at least one piece of material 48 may be configured to front portion 14 in a horizontal configuration and in a reinforced manner. In one or more embodiments, each or some of the at least one piece of material 48 may be configured to be substantially equal to and/or less than the width of front portion 14. In one or more embodiments, each or some of the at least one piece of material 48 may be configured to be of various dimensions. For example, in one or more embodiments, the length of the at least one piece of material 48 may be between about 1/32 of an inch to about 12 inches (such as, for example, but not limited to about 1 and ⅝ inches in length) and the width may be between about 1/32 of an inch to about 12 inches (such as, for example, but not limited to about ½ an inch in width). In one or more embodiments, the at least one piece of material 48 may be separated from each other by various distances including between about 1/32 of an inch to about 40 inches (such as, for example, but not limited to about 1 and ½ inches).

In one or more embodiment, various items may be releasably and/or non-releasably attached, carried and/or displayed on front portion 14 (see above for a list of various items). For example, as shown in FIG. 4, in one or more embodiment, a personal identification badge 50 may be attached, carried and/or displayed on one or more of the at least one piece of material 48. In one or more embodiments, personal identification badge 50 may include a badge clip 52 with one end 54 of the clip configured to attach to one of the at least one piece of material 48. In one or more embodiments, badge clip 52 may be configured so that when one end of the clip is articulated the other end 54 opens. In one or more embodiments, while the open end 54 of the badge clip 52 remains open, the open end 54 may be brought into position and straddles one of the at least one piece of material 48. In one or more embodiments, once in position, a user 20 may release the articulation and allow the open end 54 of the clip to close onto one of the at least one piece of material 48.

Figure 7:
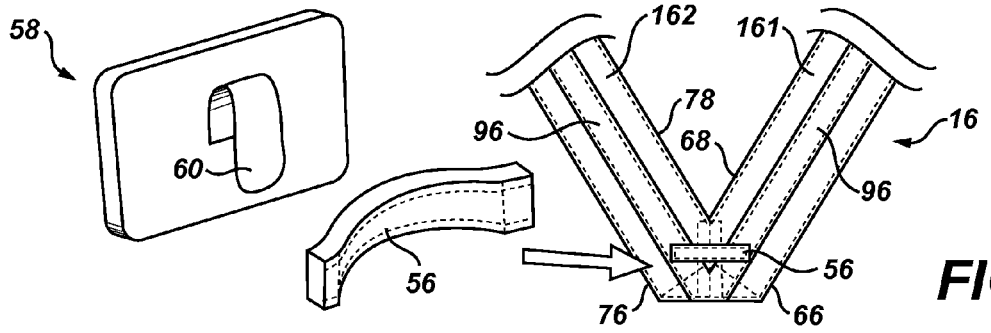
FIG. 7 shows one embodiment of aspects of a bottom portion which may be configured with at least one means for attaching, carrying and/or displaying items.
Figure 8:
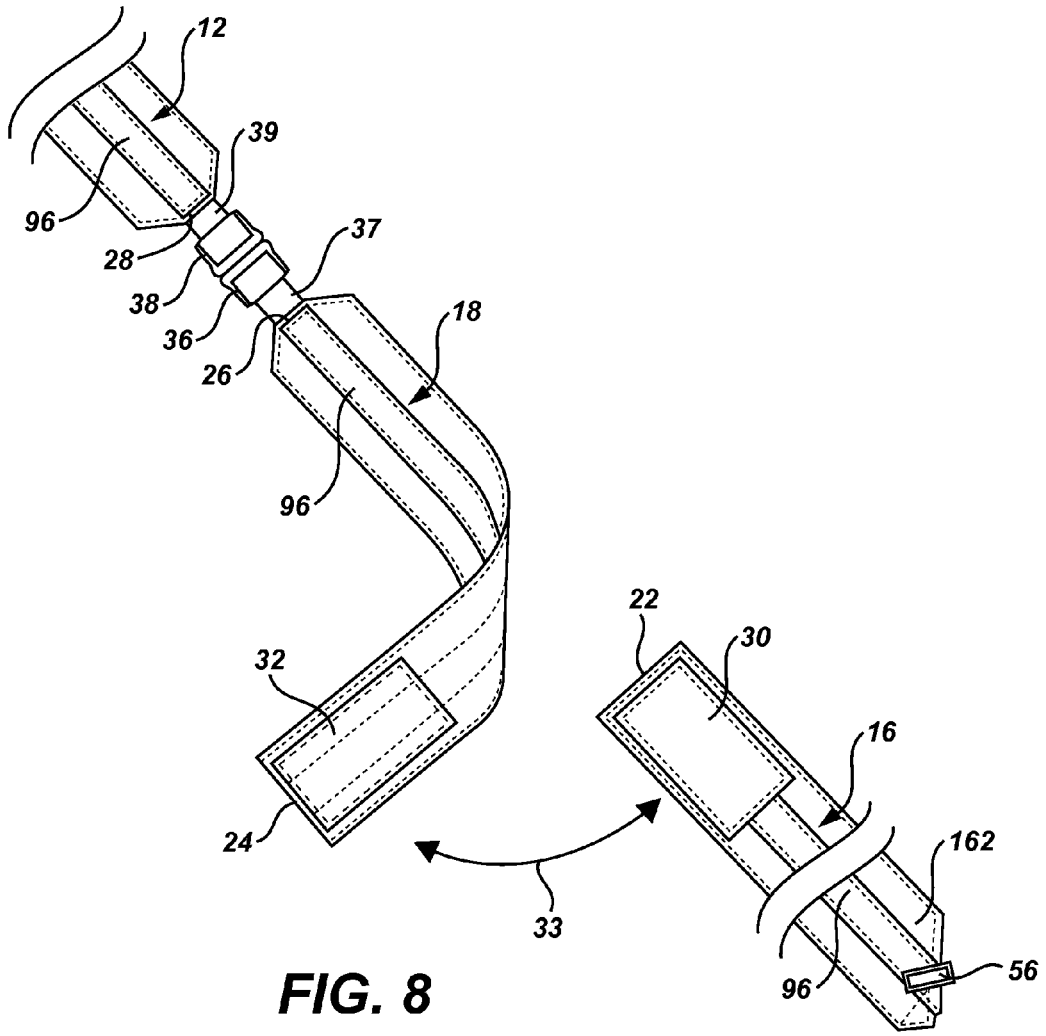
FIG. 8 shows one embodiment of aspects of a bottom portion, a back portion and a top portion and a means whereby bottom portion may be releasably configured to back portion and a means whereby back portion may be releasably configured to top portion.

FIGS. 5A, 5B, 5C, 5D and 5E show various embodiments of aspects of bottom portion 16. In one or more embodiments, bottom portion 16 may be configured to overlay portions of user's 20 right or left hip and/or waist. In one or more embodiments, bottom portion 16 may include second bottom portion 162 and first bottom portion 161. In one or more embodiments, first bottom portion 161 may overlay portions of user's 20 right (see FIG. 1) or left hip and/or waist (such as, but not limited to the ventral or anterior section of the user's 20 frontal plane). In one or more embodiments, second bottom portion 162 may overlay portions of user's 20 right (see FIG. 2) or left hip and/or waist (such as, but not limited to the dorsal or posterior section of the user's 20 frontal plane). In one or more embodiments, first bottom portion 161 and second bottom portion 162 may be configured in such a fashion so that article 10 may provide a comfortable and natural fit to and on user's 20 body. In one or more embodiments, first bottom portion 161 and second bottom portion 162 may be configured to form, at some location, an angle 163 of various degrees. For example, in one or more embodiments, the angle 163 may be configured to be between about 180 degrees to about 1 degree (such as, for example, but not limited to about a 125 degree angle). In one or more embodiments, bottom portion 16 may be configured with at least one means for being releasably and/or non-releasably configured to at least one aspect of article 10 (such as, for example, but not limited to as illustrated in FIG. 8). In one or more embodiments, bottom portion 16 may be configured with at least one means for attaching, carrying and/or displaying items (such as, for example, but not limited to as illustrated in FIG. 7).

Figure 5A:
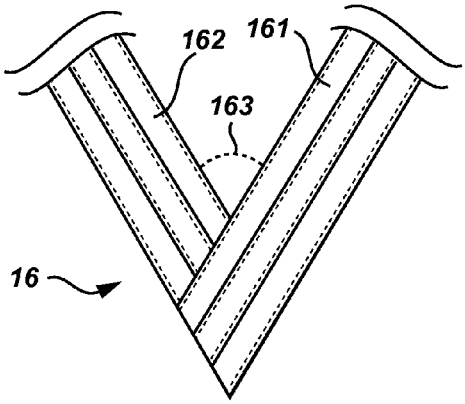
FIG. 5A shows one embodiment of aspects of a bottom portion of the disclosure wherein one aspect of bottom portion may overlap another aspect of bottom portion.

FIG. 5A shows one embodiment of aspects of bottom portion 16 wherein first bottom portion 161 may overlap second bottom portion 162 so that first bottom portion 161 may be positioned superior to second bottom portion 162. In one or more embodiments, first bottom portion 161 and second bottom portion 162 may be configured to form, at some location, an angle 163 which may be about 125 degrees.

Figure 5B:
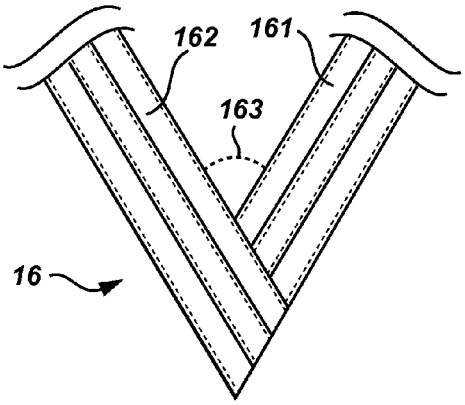
FIG. 5B shows one embodiment of aspects of a bottom portion of the disclosure wherein one aspect of bottom portion (which may be different than FIG. 5A) may overlap another aspect of bottom portion.

FIG. 5B shows one embodiment of aspects of bottom portion 16 wherein second bottom portion 162 may overlap first bottom portion 161 so that second bottom portion 162 may be positioned superior to first bottom portion 161. In one or more embodiments, first bottom portion 161 and second bottom portion 162 may be configured to form, at some location, an angle 163 which may be about 125 degrees.

Figure 5C:
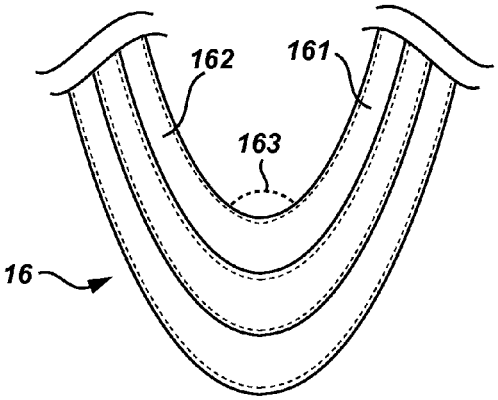
FIG. 5C shows one embodiment of aspects of a bottom portion of the disclosure wherein the configuration of one aspect of bottom portion to another aspect of bottom portion may be continuous.

FIG. 5C shows one embodiment of aspects of bottom portion 16 wherein the configuration of first bottom portion 161 and second bottom portion 162 to each other may continuous. In one or more embodiments, first bottom portion 161 and second bottom portion 162 may be configured to form, at some location, an angle 163 which may be about 125 degrees.

Figure 5D:
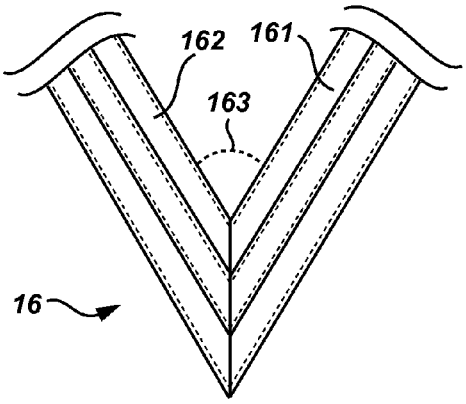
FIG. 5D shows one embodiment of aspects of a bottom portion of the disclosure wherein one aspect of bottom portion may be configured to another aspect of bottom portion.

FIG. 5D shows one embodiment of aspects of bottom portion 16 wherein first bottom portion 161 and second bottom portion 162 may be configured together about at the location where the anterior section and the dorsal section meet on user's 20 frontal plane. In one or more embodiments, first bottom portion 161 and second bottom portion 162 may be configured to form, at some location, an angle 163 which may be about 125 degrees.

Figure 5E:
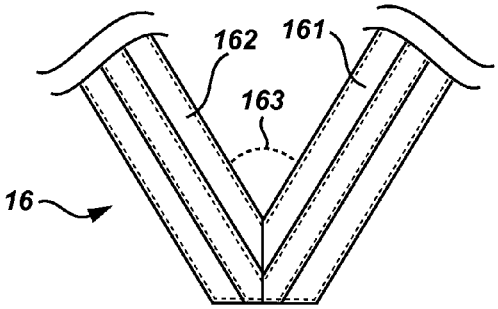
FIG. 5E shows one embodiment of aspects of a bottom portion of the disclosure wherein one aspect of bottom portion may be configured to another aspect of bottom portion in a different configuration than as illustrated in FIG. 5D.

FIG. 5E shows one embodiment of aspects of bottom portion 16 wherein first bottom portion 161 and second bottom portion 162 may be configured together about at the location where the anterior section and the dorsal section meet on user's 20 frontal plane and wherein aspects of first bottom portion 161 and second bottom portion 162 may be angled and/or folded. In one or more embodiments, first bottom portion 161 and second bottom portion 162 may be configured to form, at some location, an angle 163 which may be about 125 degrees.

FIGS. 6A, 6B, 6C, 6D, 6E, 6F and 6G show various aspects of the configuration of the embodiment of aspects of bottom portion 16 as illustrated in FIGS. 5D and 5E.

Figure 6A:
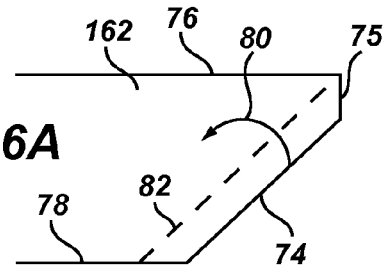
FIG. 6A shows one embodiment of one step in the configuration of aspects of one embodiment of a bottom portion.

FIG. 6A shows one embodiment of second bottom portion 162 which may include a right edge 74, a bottom edge 76, and a top edge 78. Although bottom edge 76 is shown in FIG. 6A as being above top edge 78, the view in FIG. 6A is an upside down view of bottom portion's 16 interior surface which may be configured, in one or more embodiments, to be proximal to the user's 20 body. In one or more embodiments, right edge 74 may be configured to various dimensions. For example, in one or more embodiments, right edge 74 may be configured to be between about 1/32 of an inch to about 12 inches in length (such as, for example, but not limited to about 4 inches in length) and at least some portions of right edge 74 may be configured to be between about a 180 degree angle to about a 1 degree angle (such as, for example, but not limited to about a 125 degree angle). In one or more embodiments, right edge 74 may include a right edge 75 which may be configured so that, once folded, it may run substantially parallel to bottom edge 76. In one or more embodiments, right edge 74 may be folded 80 at crease 82 about 1/32 of an inch to about 12 inches (such as, for example, but not limited to about ½ an inch) onto the proximal side of second bottom portion 162.

Figure 6B:
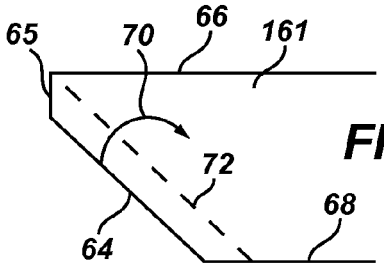
FIG. 6B shows one embodiment of another step in the configuration of aspects of one embodiment of a bottom portion.

FIG. 6B shows one embodiment of first bottom portion 161 which may include a left edge 64, a bottom edge 66, and a top edge 68. Although bottom edge 66 is shown in FIG. 6B as being above top edge 68, the view in FIG. 6B is an upside down view of bottom portion's 16 interior surface which may be configured, in one or more embodiments, to be proximal to the user's 20 body. In one or more embodiments, left edge 64 may be configured to various dimensions. In one or more embodiments, left edge 64 may be configured to be between about 1/32 of an inch to about 12 inches in length (such as, for example, but not limited to about 4 inches in length) and at least some portions of left edge 64 may be configured to be between about a 180 degree angle to about a 1 degree angle (such as, for example, but not limited to about a 125 degree angle). In one or more embodiments, left edge 64 may include a left edge 65 which may be configured so that, once folded, it may run substantially parallel to bottom edge 66. In one or more embodiments, left edge 64 may be folded 70 at left edge's 64 crease 72 about 1/32 of an inch to about 12 inches (such as, for example, but not limited to about ½ an inch) onto the proximal side of first bottom portion 161.

Figure 6C:
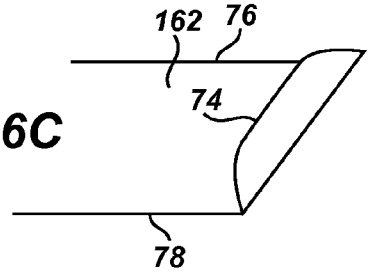
FIG. 6C shows one embodiment of another step in the configuration of aspects of one embodiment of a bottom portion.

FIG. 6C shows one embodiment of aspects of bottom portion 16 wherein the process illustrated and described in relation to FIG. 6A may be completed.

Figure 6D:
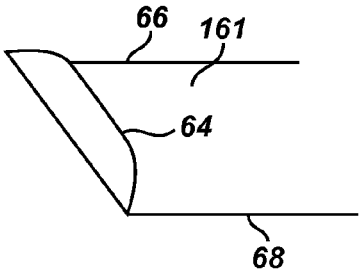
FIG. 6D shows one embodiment of another step in the configuration of aspects of one embodiment of a bottom portion.

FIG. 6D shows one embodiment of aspects of bottom portion 16 wherein the process illustrated and described in relation to FIG. 6B may be completed.

Figure 6E:
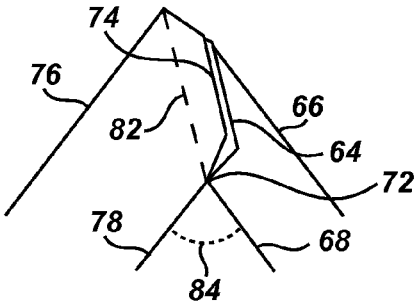
FIG. 6E shows one embodiment of another step in the configuration of aspects of one embodiment of a bottom portion.

FIG. 6E shows one embodiment of aspects of bottom portion 16 wherein left edge's 64 crease 72 and right edge's 74 crease 82 may be configured together (via, for example, but not limited to sewing) thereby connecting first bottom portion 161 and second bottom portion 162. In one or more embodiments, first bottom portion 161 and second bottom portion 162 may be configured to form an angle 84 of various degrees. In one or more embodiments, angle 84 may be configured to be between about 180 degrees to about 1 degree (such as, for example, but not limited to about 125 degrees).

Figure 6F:
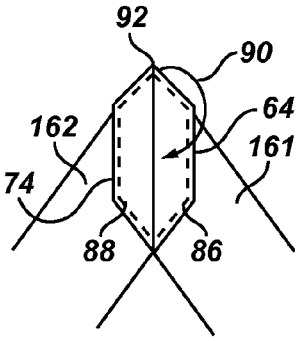
FIG. 6F shows one embodiment of another step in the configuration of aspects of one embodiment of a bottom portion.

FIG. 6F shows one embodiment of aspects of bottom portion 16 wherein left edge 64 may be configured (via, for example, but not limited to sewing 86) to first bottom portion 161 and right edge 74 may be configured (via, for example, but not limited to sewing 88) to second bottom portion 162. In one or more embodiments, point 92 may be folded 90 over to a desired length (such as, for example, but not limited to about 1 and ½ inches) onto the proximal side of bottom portion 16 (this step may be absent from the embodiment of bottom portion 16 illustrated in FIG. 5D).

Figure 6G:
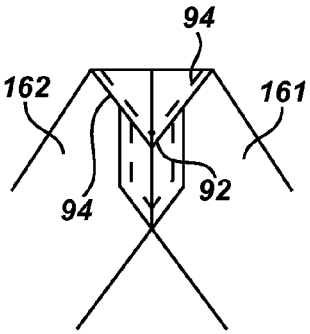
FIG. 6G shows one embodiment of another step in the configuration of aspects of one embodiment of a bottom portion.

FIG. 6G shows one embodiment of aspects of bottom portion 16 wherein point 92 and the other aspects of bottom portion 16 may be configured to aspects of bottom portion 16 (via, for example, but not limited to sewing 94) (this step may be absent from the embodiment of bottom portion 16 illustrated in FIG. 5D).

FIG. 7 shows one embodiment of aspects of bottom portion 16 which may be configured with at least one means for attaching, carrying and/or displaying items. For example, in one or more embodiments, as shown in FIGS. 1, 2, and 7, bottom portion 16 may be configured with at least one piece of material 56 upon which various items may be releasably and/or non-releasably attached, carried and/or displayed. In one or more embodiments, the at least one piece of material 56 may be configured to bottom portion 16 in a fashion similar to how belt loops may be sewn to pants. In one or more embodiments, the at least one piece of material 56 may be configured to bottom portion 16 in a horizontal configuration and in a reinforced manner. In one or more embodiments, the at least one piece of material 56 may be sewn onto first bottom portion 161 and second bottom portion 162. In one or more embodiments, the at least one piece of material 56 may be configured to be substantially equal to and/or less than the width of bottom portion 16. In one or more embodiments, the at least one piece of material 56 may be configured to various dimensions. In one or more embodiments, the at least one piece of material 56 may be configured to be between about 1/32 of an inch to about 12 inches in length (such as, for example, but not limited to about 2 and 5/8 inches in length) and about 1/32 of an inch to about 12 inches in width (such as, for example, but not limited to about ½ an inch in width). In one or more embodiment, various items may be releasably and/or non-releasably attached, carried and/or displayed on bottom portion 16 (see above for a list of various items). For example, as shown in FIG. 7, in one or more embodiment, a cell phone holster 58 may be attached, carried and/or displayed on the at least one piece of material 56. Cell phone holster 58 may be configured with a belt clip 60 which may be attached to and/or carried and/or displayed on the at least one piece of material 56.

FIG. 8 shows one embodiment of aspects of bottom portion 16. In one or more embodiments, second bottom portion 162 may include an end 22. Although FIG. 8 (and elsewhere) shows the edges of end 22 as being squared, in one or more embodiments, the shape, size, texture, color and other dimensions, characteristics and functionalities may be modified as needed and/or desired. In one or more embodiments, the superior side of end 22 may be configured with at least one means for being releasably and/or non-releasably configured to other aspects of article 10. For example, in one or more embodiments, end 22 may be configured with VELCRO® material 30. In one or more embodiments, VELCRO® material 30 may be configured to various dimensions. In one or more embodiments. VELCRO® material 30 may be configured to be between about 1/32 of an inch to about 60 inches in length (such as, for example, but not limited to about 4 and ⅝ inches in length) and about 1/32 of an inch to about 12 inches in width (such as, for example, but not limited to about 2 inches in width). In one or more embodiments, VELCRO® material 30 may be sewn on to end 22. In one or more embodiments, VELCRO® material 30 may include hook (or loop) configurations capable of being configured to material including complementary loop (or hook) configurations (such as, for example, but not limited to VELCRO® material 32 described below).

FIG. 8 also shows one embodiment of back portion 18. In one or more embodiments, back portion 18 may be configured to overlay parts of user's 20 back. In one or more embodiments, back portion 18 may include an end 24 and an end 26.

In one or more embodiments, end 24 may be situated on a user's 20 back and/or near a user's 20 hip and/or waist (see FIG. 2). Although FIG. 8 (and elsewhere) shows the edges of end 24 as being squared, in one or more embodiments, the shape, size, texture, color and other dimensions, characteristics and functionalities may be modified as needed and/or desired. In one or more embodiments, the inferior side of end 24 may be configured with at least one means for being releasably and/or non-releasably configured to other aspects of article 10. For example, in one or more embodiments, end 24 may be configured with VELCRO® material 32. In one or more embodiments. VELCRO® material 32 may be configured to various dimensions. In one or more embodiments, VELCRO® material 32 may be configured to be between about 1/32 of an inch to about 60 inches in length (such as, for example, but not limited to about 4 and ⅝ inches in length) and about 1/32 of an inch to about 12 inches in width (such as, for example, but not limited to about 2 inches in width). In one or more embodiments, VELCRO® material 32 may be sewn on to end 24. In one or more embodiments, VELCRO® material 32 may include loop (or hook) configurations capable of being configured to material including complementary hook (or loop) configurations (such as, for example, but not limited to VELCRO® material 30 described above). In one or more embodiments, VELCRO® material 32 may be positioned over at least some aspect of VELCRO® material 30 and releasably configured 33 to it by pushing them together and pulling them apart.

In one or more embodiments, end 26 may be situated on a user's 20 back and/or near a user's 20 shoulder (see FIG. 2). Although FIG. 8 (and elsewhere) shows the edges of end 26 as being angled, in one or more embodiments, the shape, size, texture, color and other dimensions, characteristics and functionalities may be modified as needed and/or desired. In one or more embodiments, end 26 may be configured to material 37 by various means (such as, for example, but not limited to sewing). In one or more embodiments, material 37 may be configured from various materials to various dimensions. In one or more embodiments, material 37 may be configured from heavy duty webbing and/or strap material with a width between about 1/32 of an inch to about 12 inches (such as, for example, but not limited to about ¾ of an inch wide) and a length between about 1/32 of an inch to about 12 inches (such as, for example, but not limited to about 1 and ½ inches in length). In one or more embodiments, none or at least some of material's 37 length (such as, for example, but not limited to between about 1/32 of an inch to about 12 inches) may be sewn onto, covered and/or in between layers (in the instance of multiple layers) by end 26. In one or more embodiments, material 37 may be configured to breakaway device 36 by various means (such as, for example, but not limited to a buckle or sewing). In one or more embodiments, breakaway device 36 may provide back portion 18 with the ability to be configured to other aspects of article 10 (such as, for example, but not limited to, a complementary breakaway device like breakaway device 38 which may be configured to top portion 12 as described above) and/or other items. In one or more embodiments, breakaway device 36 may be configured to be about ¼ of an inch in height, about 1 and ¼ inches in width, and about ⅝ of an inch in length. In one or more embodiments, breakaway device 36 may have a weight bearing capacity similar to or more than what may be conventionally found in a lanyard possessing breakaway capabilities.

Figure 9A:
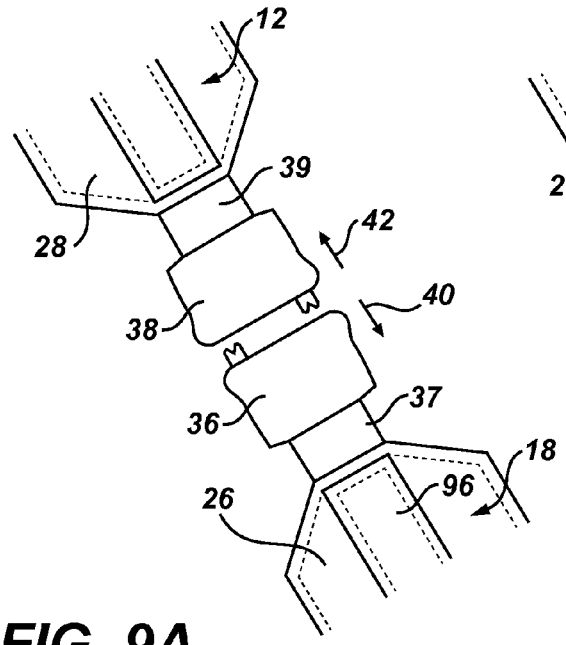
FIG. 9A show one embodiment of two breakaway devices configured separately.
Figure 9B:
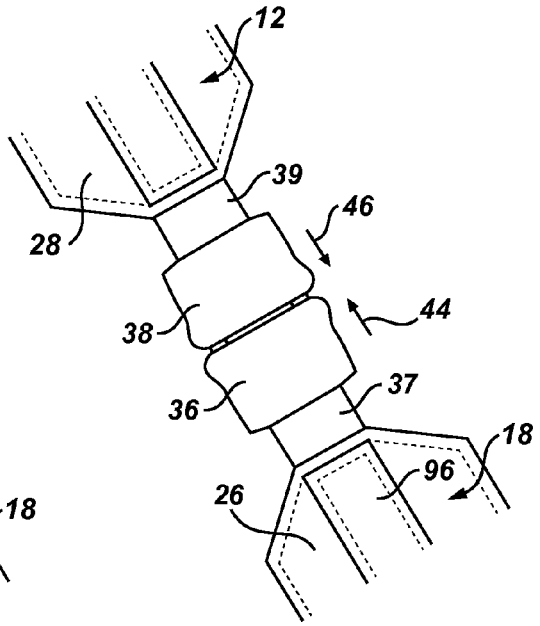
FIG. 9B show one embodiment of two breakaway devices configured together.

FIGS. 9A and 9B show one embodiment of a breakaway device's functionality. Although the only aspects of article 10 illustrated in FIGS. 2, 3, 9A and 9B (and elsewhere) shown to be configured with breakaway devices may be top portion 12 and back portion 18, in one or more embodiments, other aspects of article 10 may be configured with breakaway devices. As shown in FIGS. 9A and 9B, in one or more embodiments, breakaway device 36 and breakaway device 38 may be configured to separate when pulled in opposite directions 40, 42 and reconnect when properly aligned and pushed together in directions 44, 46 towards each other.

Figure 10:
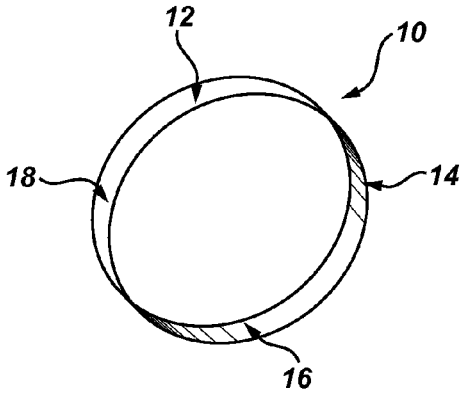
FIG. 10 shows one embodiment of aspects of the disclosure in a continuous loop configuration.

FIG. 10 shows one embodiment of article 10 wherein top portion 12, front portion 14, bottom portion 16, and back portion 18 may be configured in a continuous loop.

Figure 11:
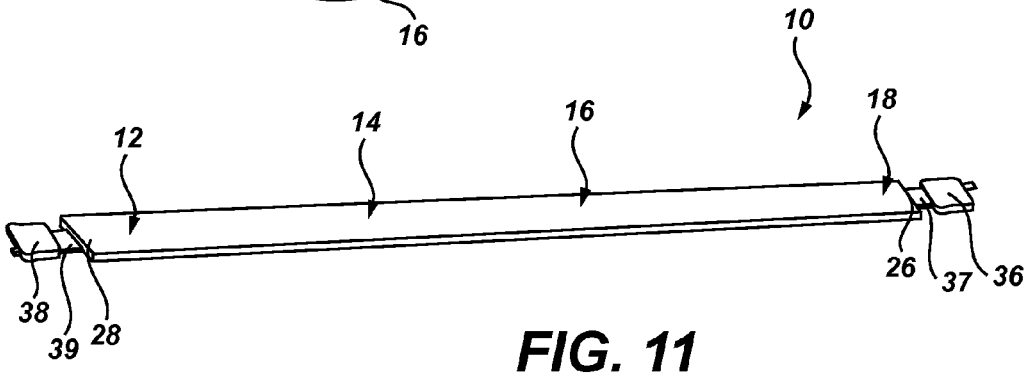
FIG. 11 shows one embodiment of aspects of the disclosure in a continuous configuration and where one end of the disclosure may be releasably configured to another end of the disclosure.

FIG. 11 shows one embodiment of article 10 wherein top portion 12 may be configured to be continuous with front portion 14, wherein front portion 14 may be configured to be continuous with bottom portion 16, wherein bottom portion 16 may be configured to be continuous with back portion 18, and wherein back portion 18 may be releasably configured to top portion by means of breakaway devices 36 and 38 respectively.

Figure 12:
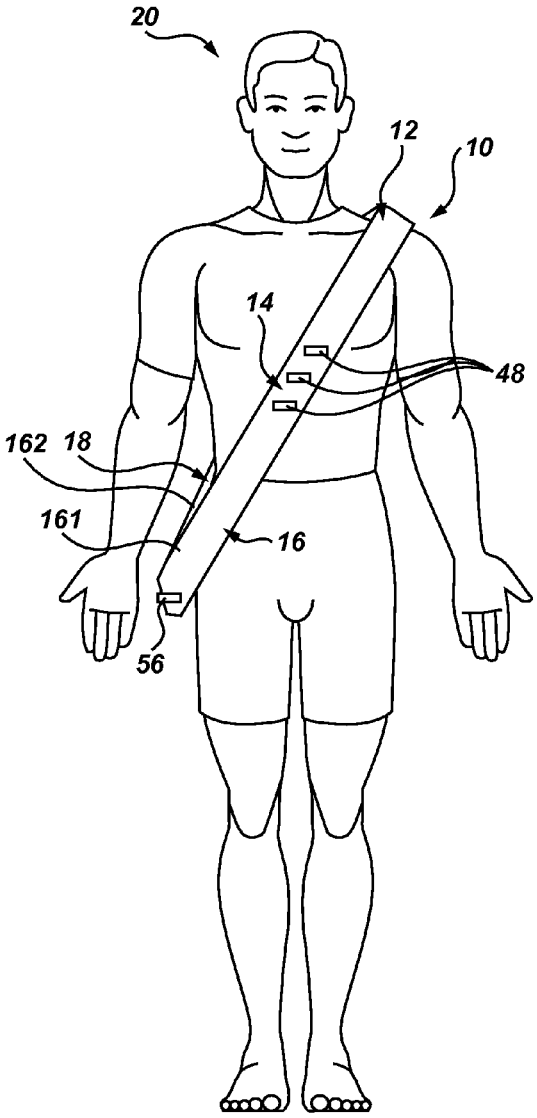
FIG. 12 shows a view of one embodiment of an anterior side of a user wearing an embodiment of the disclosure which may be configured differently than the embodiment shown in FIG. 1.
Figure 13:
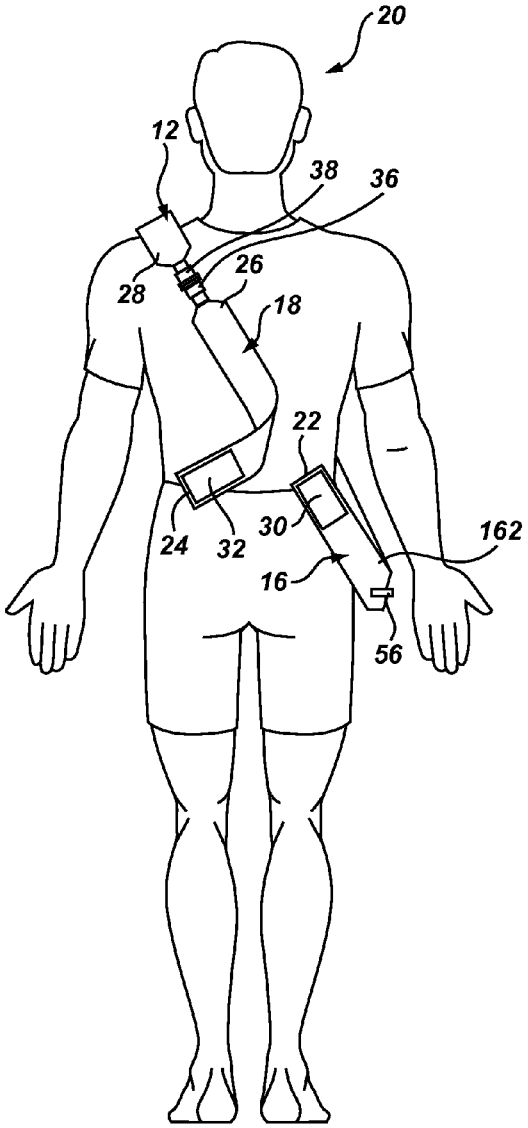
FIG. 13 shows a view of one embodiment of a posterior side of the user wearing one embodiment of the disclosure which may be configured differently than the embodiment shown in FIG. 2.

FIGS. 12 and 13 show one embodiment of aspects of an article 10 which, like the embodiment illustrated in FIGS. 1 and 2, may be configured to include top portion 12, front portion 14, bottom portion 16, and back portion 18; however, the embodiment of article 10 illustrated in FIGS. 12 and 13 may be configured without reflective tape 96. In one or more embodiments, aspects of the embodiment of article 10 illustrated in FIGS. 12 and 13 may be configured for a casual look or professional look. In one or more embodiments, aspects of the embodiment of article 10 illustrated in FIGS. 12 and 13 may be configured with at least one layer of material (such as, for example, but not limited to jean material for a casual look and/or black polyester for a professional look).

FIG. 12 shows a view of one embodiment of the anterior side of user's 20 body wherein one or more embodiments of article 10 may be configured so that top potion 12 may overlay the user's 20 left shoulder and continue downward from top portion 12 in a diagonal direction to front portion 14 which may be situated across a user's 20 chest to bottom portion 16 which may overlay the user's 20 right hip and/or waist.

FIG. 13 shows a view of one embodiment of the posterior side of user's 20 body wherein one or more embodiments of article 10 may be configured so that top potion 12 may overlay the user's 20 left shoulder and continue downward from top portion 12 in a diagonal direction and ultimately across a user's 20 back and towards back portion 18 and towards bottom portion 16 which may overlay the user's 20 right hip and/or waist.

In one or more embodiments, the length of at least some aspect of article 10 may be as follows—the combined length of top portion 12, front portion 14 and some aspects of bottom portion 16, starting at top portion's 12 end 28 and continuing over and around user's 20 left shoulder to front portion 14 and downward diagonally across the user's 20 chest and abdomen to the location wherein first bottom portion's 161 crease 72 and second bottom portion's 162 crease 82 may be configured together, may be about 28 and ½ inches in length, about 30 and ½ inches in length, about 33 and ½ inches in length, and/or about 36 and ½ inches in length. In one or more embodiments, the length of some aspects of bottom portion 16, starting at the location wherein first bottom portion's 161 crease 72 and second bottom portion's 162 crease 82 may be configured together and continuing upward diagonally on the user's 20 back to bottom portion's 16 end 22, may be about 13 and ½ inches in length, about 14 and ½ inches in length, about 16 inches in length, and/or about 17 and ½ inches in length. In one or more embodiments, the length of back portion 18, starting from end 24 and continuing to end 26 may be about 14 inches in length, about 15 inches in length, about 16 and ½ inches in length, and/or about 18 inches in length. In one or more embodiments, the length of martial 39 and material 37 may each be about 1 inch and the length of breakaway device 38 and breakaway device 36 may each be about ¾ of an inch. In one or more embodiments, the length of article 10 may be adjustable by means of VELCRO® material 32 and VELCRO® material 30 (as indicated herein). In one or more embodiments, various sizes (such as, small/medium, medium/large, large/extra-large, extra-large/double extra-large, and/or more or less sizes) of article 10 may be provided. In one or more embodiments, reflective tape 96 may cover some aspect of front portion 14 and bottom portion 16 and some aspects of top portion 12 and back portion 18.

In one or more embodiments, some aspect of article 10 (such as, for example, but not limited to top portion 12, front portion 14, bottom portion 16 and/or back portion 18) may be configured with at least one pocket of various dimensions configured from various materials. For example, in one or more embodiments, front portion may be configured with a pocket which may be substantially the same and/or less than the width of the aspect of article 10 on which the pocket may be configured (such as, for example, about 2 inches in width and about 3 inches in length). In one or more embodiments, the at least one pocket may include a zipper.

Different embodiments of the disclosure may implement the above scenario(s) and/or variations of the above scenario(s). In one or more embodiment, any of the structures, functions, and/or features of any aspect of the disclosure expressly or inherently described or illustrated herein may be combined with any of the structures, functions, and/or features of any other aspect of the aspect of the disclosure expressly or inherently described or illustrated herein. In one or more embodiments, each component of the disclosures may be provided in any color.

In one or more embodiments, other modifications may be made to the embodiments illustrated in the drawings or otherwise disclosed herein or equivalents, which may include and/or have the capacity to utilize abilities, systems, devices, means, functionality, features, methods and/or uses not expressly and/or impliedly described herein and/or illustrated in the drawings to this application but which may be obvious to one skilled in the art, whether developed later or known at the time of filing.

It should be understood that the present systems, apparatuses, devices, means, methods and structures are not intended to be limited to the particular forms disclosed; rather, they are to cover all combinations, modifications, equivalents, and alternatives. A system, apparatuses, devices, means, methods or structure that is configured in a certain way may be configured in at least that way, but may also be configured in ways that are not described or illustrated. The disclosure may be configured to function with a variety of systems, apparatuses, devices, methods, means, and structures. Different materials may be used for individual components. Different materials may be combined in a single component.

The present disclosure may be embodied in other specific forms without departing from its spirit or essential characteristics. It is appreciated that various features of the above described examples and embodiments may be mixed and matched to form a variety of other combinations and alternatives. The described embodiments are to be considered in all respects as illustrative and not restrictive. Other embodiments and/or implementations are within the scope of the following claims and at least all changes which come within the meaning and range of equivalency of the claims are to be embraced within their scope. The scope of the invention may be indicated by the appended claims rather than by any of the foregoing description.

What is claimed is:

1. An article comprising:

a top portion;

a front portion;

a bottom portion;

a back portion;

wherein the top portion is operably configured to a first breakaway device, wherein the back portion is operably configured to a second breakaway device, wherein the first breakaway device and the second breakaway device are releasably configurable together such that the top portion may be releasably configured to the back portion;

wherein the first breakaway device and the second breakaway device may be releasably configurable together when such are aligned and pushed together towards each other and separated when such are pulled away from each other;

wherein the bottom portion comprises a first hook or loop fastener, wherein the back portion comprises a second hook or loop fastener complementary to the first hook or loop fastener, wherein the first hook or loop fastener and the second hook or loop fastener are releasably configurable together such that the bottom portion may be releasably configured to the back portion;

wherein the area of the back portion on which the bottom portion may be releasably configured to the back portion is alternate to the area of the back portion on which the top portion may be releasably configured to the back portion;

wherein the configuration of the first hook or loop fastener to the second hook or loop fastener provides for the adjustability of the length of the article;

wherein the first breakaway device and the second breakaway device assume configurations alternative to the first hook or loop fastener and the second hook or loop fastener;

wherein the article is designed to be worn substantially diagonally across a user's body such that the top potion overlays the user's shoulder and the bottom portion overlays the user's hip; and wherein the bottom portion is designed to allow a first item to be attached to and carried on it, wherein the front portion is designed to allow a second item to be attached to and carried on it.

2. The article of claim 1, wherein the first item comprises a cell phone.

3. The article of claim 2, wherein the second item comprises a personal identification badge.

4. The article of claim 3, wherein the top portion is configured continuous to the front portion and the bottom portion is configured continuous to the front portion.

5. The article of claim 1, wherein the front portion further comprises a means for attaching and carrying the second item on the front portion.

6. The article of claim 1, wherein the bottom portion further comprises a means for attaching and carrying the first item on the bottom portion.

7. The article of claim 1, further comprising reflective tape located on at least one aspect of the article.

8. The article of claim 1, further comprising a pocket.

9. The article of claim 1, wherein the top portion, the front portion, the bottom portion and the back portion are comprised of at least one layer of material.

10. The article of claim 1, wherein the top portion, the front portion, the bottom portion and the back portion are comprised of at least two layers of material.

11. The article of claim 1, wherein the bottom portion further comprising:

a first bottom portion; and a second bottom portion.

12. The article of claim 11, wherein the first bottom portion and the second bottom portion are configured together.

13. The article of claim 11, wherein the first bottom portion and the second bottom portion are configured together so that at least one aspect of the first bottom portion is positioned superior to and overlaps at least one aspect of the second bottom portion.

14. The article of claim 11, wherein the first bottom portion and the second bottom portion are configured together so that at least one aspect of the second bottom portion is positioned superior to and overlaps at least one aspect of the first bottom portion.

15. The article of claim 11, wherein the first bottom portion and the second bottom portion are configured together so that at least one aspect of the configuration of the first bottom portion and the second bottom portion to each other is continuous.

16. The article of claim 11, wherein the first bottom portion and the second bottom portion are configured together at a location where the user's anterior section and dorsal section substantially meet.

17. The article of claim 11, wherein the first bottom portion and the second bottom portion are configured together and form an angle between about 180 degrees and about 1 degree.

* * * * *